United States Patent [19]

Nylund et al.

[11] 3,971,449

[45] July 27, 1976

[54] PROCEDURE FOR CONTROLLING A ROCK DRILL AND ROCK DRILL FOR CARRYING OUT THE PROCEDURE

[75] Inventors: Roger Nylund; Aulis Holmala, both of Tampere, Finland

[73] Assignee: Oy Tampella AB, Tampere, Finland

[22] Filed: Oct. 9, 1974

[21] Appl. No.: 513,291

[30] Foreign Application Priority Data

Oct. 9, 1973 Finland ..... 3133/73
Oct. 1, 1974 Finland ..... 2869/74

[52] U.S. Cl. ..... 175/27; 173/11; 175/203

[51] Int. Cl.[2] ..... E21B 19/08

[58] Field of Search ..... 175/27, 40, 45, 50, 175/203, 122, 162; 173/4, 1, 2, 8, 11; 73/151.5, 151

[56] References Cited

UNITED STATES PATENTS

| | | | |
|---|---|---|---|
| 2,320,874 | 6/1943 | Lehmann | 173/4 |
| 2,322,741 | 6/1943 | Osgood | 173/4 |
| 3,189,103 | 6/1965 | Attebo et al. | 173/11 X |
| 3,373,823 | 3/1968 | Fullerton et al. | 175/27 X |
| 3,461,978 | 8/1969 | Whittle | 175/27 |
| 3,593,807 | 7/1970 | Klima | 175/27 X |
| 3,605,910 | 9/1971 | Deeter et al. | 173/4 |
| 3,613,805 | 10/1971 | Lindstad et al. | 173/4 |
| 3,648,783 | 3/1972 | Lackey | 173/4 |
| 3,746,102 | 7/1973 | Griffin et al. | 173/4 |

*Primary Examiner*—Ernest R. Purser
*Assistant Examiner*—Richard E. Favreau
*Attorney, Agent, or Firm*—Haseltine, Lake & Waters

[57] ABSTRACT

An arrangement for controlling the drilling functions of a full profile rock drill in which the speed of rotation of the cutting head and the feed force of the cutting head are controlled so that the rate of penetration of the drill bit reaches its optimum rate as a function of the feed force. The full profile of drilling apparatus has a part of the cutting head in which cutters are freely rotatable. The change of the rate of penetration of the cutting head into the rock is measured during the drilling operation, and the drilling functions are controlled on the basis of the measured results so that the cutting head feed force is either increased or decreased.

18 Claims, 5 Drawing Figures

PROCEDURE FOR CONTROLLING A ROCK DRILL AND ROCK DRILL FOR CARRYING OUT THE PROCEDURE

BACKGROUND OF THE INVENTION

The present invention concerns a procedure for controlling the drilling management functions of a whole profile rock drill apparatus, such as the speed of rotation and the feed force of the drill bit so that the rate of penetration of the drill bit reaches its maximum setting, in which whole profile rock drill apparatus the part of the drill bit penetrating into the rock consists of cutters rotatably carried by the aid of an axle at right angles to the direction of penetration. This type of drill apparatus is represented e.g. by the tunnel drill apparatus used in the making of tunnels and by the rising rock drills, which are used to produce vertical shafts in mines for ventilation, ore transporting, etc.

When rock is being drilled with a full face apparatus, the result, is influenced by structural circumstances, by the guiding and control measures and by the characteristics of the rock itself. The rock breaking, that is the rate of penetration, depends on the spacing of the hard metal pins on the conical bits, on their shape, on the dimensions of the bits and of the available power and feed force. If these characteristics are appropriate, then the rate of penetration is substantially dependent on the control measures exerted on the apparatus. In order that the best rate of penetration might be achieved, the hard metal pins should enter the rock with their entire length, and the cutting head should have an appropriate speed of rotation and torque. The rate of penetration is acted upon by controlling the feed force and the speed of rotation.

In whole profile rock drill apparatus of prior art the drill bit feed force and speed of rotation have not been automated, and the drill operator controls them in the best possible manner within his skill to reach the most advantageous rate of penetration of the drill bit. If the feed force is too low, the points of the spikes on the cutting head rolls enter the rock only partly. If on the other hand excessive feed force is applied, the whole roll is urged against the rock with unnecessary force, whereby its bearings are subjected to high stress. The drill bit feed force is most advantageous when the spikes on the drill bit rolls just enter the rock with their total length and break stone in a depth which equals the length of the spikes. In that case the flat surfaces of the roll are not urged against the rock and bearings are not unduly stressed. It is exceedingly difficult however to exercise such control that this optimum condition is maintained: the drill operator has no means to tell how the drill bits are operating at any given time. A further interfering factor is the hardness variation of the rock.

Attempts have been made to solve this problem by fitting the drill bit with pressure transducers and feeding the information from these into a data processing unit. All such attempts have failed, however, because there is no kind of pressure transducer which tolerates the conditions prevailing in connection with the drill bit. The object of the present invention is to solve the problem in an entirely new way. Furthermore, when pressure transducers are used the only information that is gained is the hardness of the rock, and this is not directly proportional to the drillability. In the invention the idea has been realized and utilized that when the drill bit feed force and speed of rotation have been adjusted to optimum, the rate of penetration of the drill bit is also highest. The invention is characterized in that during the drilling operation the change with reference to time of the rate at which the drill bit enters the rock is measured, and the drill control actions are controlled on the basis of this change so that the drill bit feed force is controlled either to be increased or to be reduced. In a manner of speaking the procedure of the present invention continuously employs the change of the penetration rate to measure the drillability of the material that is being drilled, but this requires no expensive and vulnerable pressure transducers. Moreover, the procedure can be easily automated, whereby the feed force and speed of rotation of the drill bit of the apparatus are always maintained at their most favourable setting or in other words the rate of penetration of the drill bit is mantained at its optimum setting.

SUMMARY OF THE INVENTION

In an advantageous embodiment the change of the rate of penetration of the drill bit is measured in that at predetermined intervals those distances are measured which the drill bit has entered into the rock, and the values thus obtained are mutually compared. Accordingly, the drilling operation may be arranged to proceed so that the drill apparatus checks the feed force and speed of rotation values of the drill bit at predetermined intervals. Another possibility is to measure the rate of penetration of the drill bit continuously.

In another advantageous embodiment the change of the rate of penetration of the drill bit is used as basis for such control of the drill control actions that the feed force of the drill bit is controlled and the speed of rotation of the drill bit is allowed to freely adjust itself, by keeping the power constant which is expended for the rotation.

It is also a possible procedure to control the drill controlling actions in that the feed force of the drill bit is controlled and the speed of rotation of the drill bit is allowed to freely adjust itself, by keeping constant that power which is expanded to the purpose of rotating the drill bit and producing the drill bit feed force, in combination. Such constant power supply implies in practice that when the drill bit feed force is reduced the speed of rotation of the drill bit increases, and when the feed force is increased the speed of rotation decelerates. This is in fact as it should be, because soft rock requires a low feed force and high drill bit speed, while extremely hard rock requires a high feed force and low rotational speed of the drill bit.

The controls of the drill operating actions may be arranged, according to a third advantageous embodiment, to be accomplished by the means that on the basis of each measurement of the change in drill bit penetration rate a correction command is given to the control means of the drill bit feed force. This can be advantageously accomplished in that by means of the correction command a feed force correction is obtained which has a predetermined magnitude. This correction command is one which either increases or decreases the feed force acting on the drill bit, or the correction is accomplished with determination of the direction in which the feed force will be corrected.

In a fourth advantageous embodiment the correction of the drill bit feed force is determined by comparing the change in rate of penetration with the preceding correction command.

In a fifth advantageous embodiment the feed force of the drill bit is controlled so that the specific energy does not exceed a predetermined degree or in other words it is attempted to reach that optimum setting of the rate of penetration of the drill bit which is possible by using the highest permitted specific energy degree, which specific energy is attained by determining the ratio of the consumed average drilling power per time unit to the distance which the drill bit has proceeded into the rock during the same time unit.

In another advatageous embodiment the feed force of the drill bit is controlled so that the feed force of the drill bit does not exceed the predetermined degree.

The invention also concerns a whole profile rock drill for carrying out the procedure described above. This rock drill comprises a drill bit, the part of this drill bit entering the rock consisting of rolls carried on an axle at right angles to the direction of penetration to be freely rotatable; a drill bit rotating motor; a drill bit feeding and controlling device, by the aid of which the drill control actions are controlled, such as the speed of rotation and the drill bit feed force in order to control the rate of penetration of the drill bit to be at its optimum setting. The rock drill according to the invention is characterized in that the control device for the drill control actions comprises a means measuring the change of the drill bit penetration rate, a memory unit which stores into the memory that thing if the preceding control action of the feed force of the drill bit was increasing or decreasing, and a comparator unit which compares the change of the rate of penetration of the drill bit to the preceding control action of the feed force of the drill bit.

Still in another advantageous embodiment in the rock drill, the feed force controlling apparatus of the drill bit comprises at least one element that limits the maximum rate of the feed force of the drill bit to be not higher than a predetermined magnitude. The device can be for instance a specific energy computer which determines the ratio of the consumed average drilling power per time unit to the distance which the drill bit has proceeded into the rock during the same unit, and controls the feed force of the drill bit so that the specific energy does not exceed the predetermined rate. In addition to that device or in place of it there can be a device that limits the feed force of the drill bit so that it does not exceed the predetermined maximum rate.

BRIEF DESCRIPTION OF THE DRAWING

The invention is described in the following with the aid of an example, with reference to the attached drawings, wherein.

DESCRIPTION OF THE PREFERRED EMBODIMENT

Figure 1:
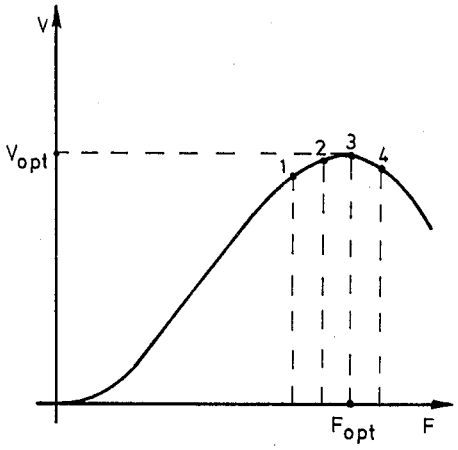
FIG. 1 presents a curve of the rate of penetration of the drill bit in function of the feed force when drilled a kind of rock.

In FIG. 1 there is shown a rightangled coordination where in the horizontal coordinate is the feed force of the drill bit and in the vertical coordinate is the rate of penetration of the drill bit. The curve in FIG. 1 presents a curve of the rate of penetration when drilling a kind of rock. In the horizontal coordinate there might as well be the drilling power because it depends linearily on the feed force. In control it is however more advantageous to have the feed force as a variable. In the FIG. 1 is shown the control action of the whole profile rock drill according to the invention where the control of the feed force of the drill bit happens in steps of predetermined magnitude. The control means only determines if the feed force is to be decreased or increased by the amount of the step, that is always of the same magnitude. The starting situation in the FIG. 1 has been supposed to be the point 1. When the feed force is now increased so the rate of penetration will be increased, too, into the point 2. According to the procedure of the invention the feed force will therefore be controlled into the same direction i.e. to be still increased to the point 3. Because the rate of penetration still increased so the control means again increases the feed force to point 4. Now, however, the rate of penetration decreased and therefore the control means controls the feed force of the drill bit into the opposite direction or in other words decreases it by the amount of predetermined step. In the curve of rate of penetration the situation is again in point 3. Because the result of drilling got better so the control goes to the same direction until to the point 2 where the direction will be changed. This way the control system controls the rate of penetration by alternating the feed force between the points 2 and 4. When the control steps will be made small enough, it means that the rate of penetration will be all the time very close to its optimum point.

Figure 2:
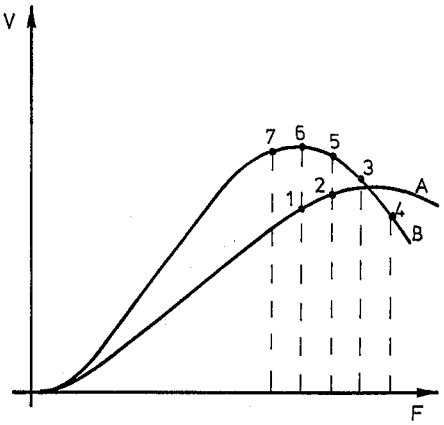
FIG. 2 presents the curves of the rate of penetration in function of the feed force when drilled two kinds of rocks of different hardness and when the rock changes from hard to soft.

In FIG. 2 there are shown two curves A and B which are curves of the rate of penetration attained when drilled two kinds of rocks of different hardness. The starting situation is suppoed to be the point 1 in the curve A which describes the drilling of hard rock. When the feed force is increased the situation in the curve moves to the point 2 just as it did in FIG. 1. Because of the increased rate of penetration the control means again increases the feed force. At that moment the hardness of the rock to be drilled changes so that the rock becomes softer. The point that marks the drilling situation in the coordination moves over to the curve B into the point 3. Because the rate of penetration however rised the control means still increases the feed force.

It means going to the point 4. By now the control means realize that the rate of penetration decreased and therefore changes the direction of the control and decreases the feed force back to the point 3. It can be said that the control means finds out that the feed force has exceeded the optimum point and tries to decrease it. From the point 3 the control system moves to the points 5, 6 and 7 one by one and again changes the direction of the control. So the feed force remains between the points 5 and 7 i.e. close to the optimum point of the curve of the rock B that is to be drilled.

Figure 3:
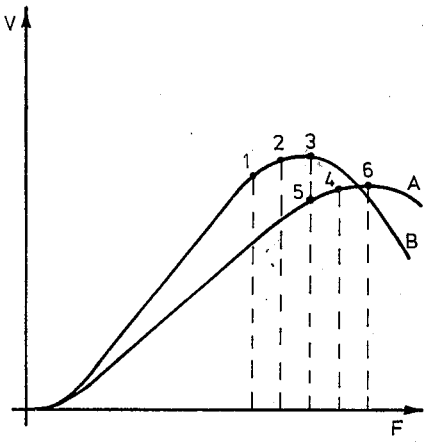
FIG. 3 corresponds FIG. 2 and presents the case when the quality of rock changes from soft to hard.

In FIG. 3 are also shown the curves of the rate of penetration of two kinds of rocks A and B of different hardness. The starting point or the point 1 is in the curve of the hard rock. In the way explained above the control means attempts to increase the feed force to the points 2 and 3 to reach the optimum point. It is supposed that at that moment the rock gets harder so that the situation moves over to the curve A to the point 4. In this situation the control means suppose that the control has moved over the optimum point in doing which it changes the direction of the control by decreasing the feed force. So the control comes to the point 5. Because the rate of penetration however again decreased so the control finds out that the preceeding control action was a mistake and again changes the direction to be increasing the feed force. This way the control goes on through the point 4 to the point 6 that is the optimum point of the curve A. This kind of seeking method is typical to the control means of the invention. It looks like the control means makes mistakes but when the hardness of the rock changes very quickly it can not be avoided. However, when the control steps are made small enough, one step into the wrong direction has no practical importance.

Figure 4:
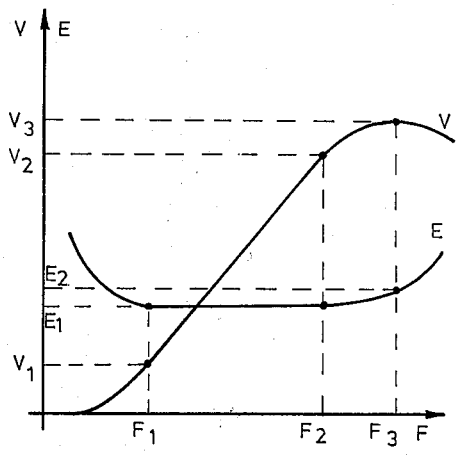
FIG. 4 presents, drawn in the same coordination, the curve of the rate of penetration and the curve of specific energy which both are in function of the feed force.

In FIG. 4 there are shown the curve of the rate of penetration and the curve of the specific energy in the same coordination. It can be seen in the curves that when the rate of penetration increases linearily in function of the feed force from $F_1$ to $F_2$ the curve of the specific energy has a special area between these two points $F_1$ and $F_2$ where the specific energy is constant and has its minimum value $E_1$. Outside this are, on both sides, the specific energy is increasing. Because the drilling action naturally is attempted to be done as economically as possible, it is clear that the operation must be close to that area of the minimum of the specific energy. However, it can also be seen in the curves that if the feed force will still be increased from $F_2$ to $F_3$ the maximum rate $V_3$ of the rate of penetration will be reached. If the specific energy $E_2$ is then only a little bit higher than the minimum rate $E_1$ of the curve, so in the drilling action can be used the feed force $F_3$ which gives the optimum of the rate of penetration. If on the contrary the specific energy curve E is increasing very fast when the control means add feed force so according to the invention some maximum limit $E_2$ is set for the specific energy. Then the control means does not exceed that limit even though the situation stops to the point before maximum point of the rate of penetration. Some other limiting factor for the feed force can also be the durability of the drill bit. In that case the maximum allowed feed force can be determined to be less than $F_3$ which give a result of maximum rate of penetration. The most advantageous case is of course that when in the FIG. 4 shown example the drill bit is durable enough for the feed force $F_3$ and it is also economical to allow the specific energy rise to $E_2$. So the limiting factors do not prevent controlling the feed force so that the maximum point of the rate of penetration will really be reached.

Figure 5:
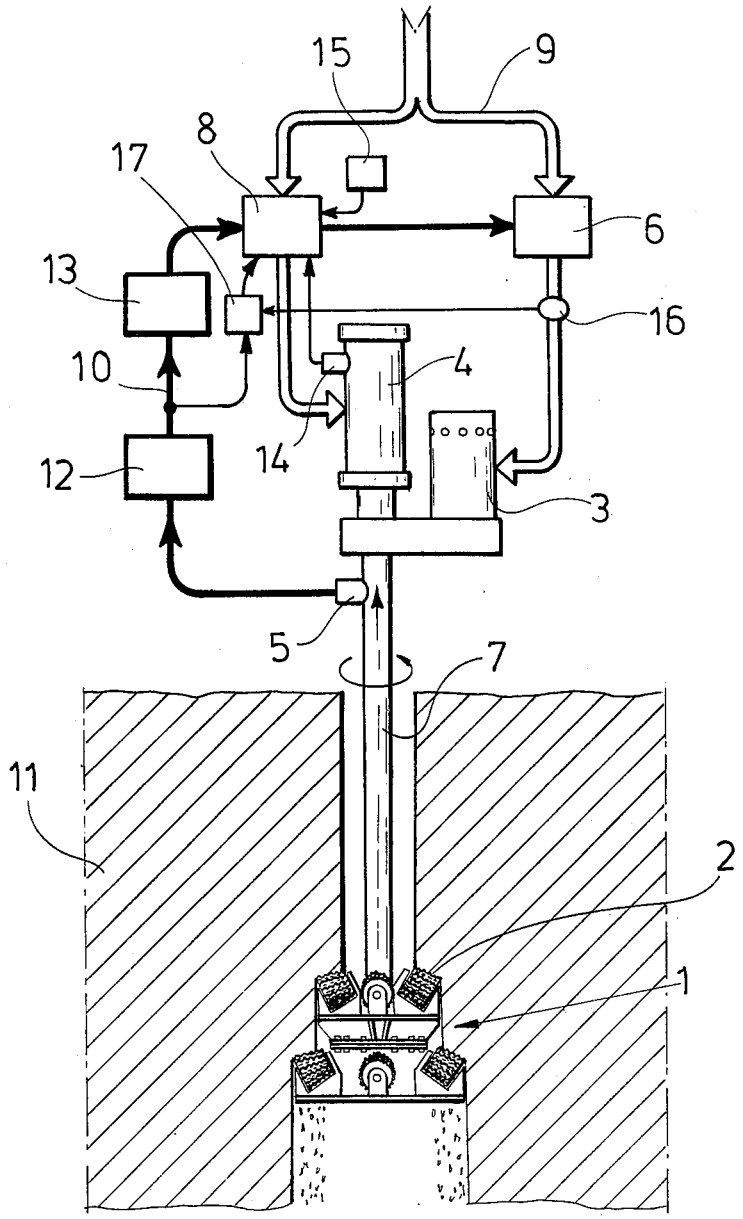
FIG. 5 presents schematically a rising rock drill according to the invention with its control means.

In the FIG. 5 presented rising rock drill comprises a drill bit 1, the part of which entering the rock 11 consists of rolls 2 carried on an axle to be freely rotatable; a shaft 7; a drill bit rotating motor 3; a drill bit feeding device 4; a means 5 measuring the rate of penetration of the drill bit and its changes; and control means 8 and 6 for the drill bit feed device and drill bit rotating motor, respectively. In the schematic drawing the energy introduced into the drill bit rotating motor 3 and the drill bit feed device 4 have been indicated by heavy arrows 9, and the flow of control information between the measuring means 5 and the control means 8 and 6 has been indicated with light arrows 10. Furthermore, the drilling operations control apparatus comprises a means 14 measuring the drill bit feed force, a memory unit 12 that stores into the memory the direction of the preceding control command of the drill bit feed force, a comparison unit 13 which compares the preceding control command to the change of the rate of penetration, a means 16 which measures the power expended for rotation of the drill bit, a means 17 which computes the specific energy and a means 15 which limits the feed force so that it does not exceed the predetermined upper limit.

When the drill is operating, the drill bit penetration rate measuring means 5 measures, for instance at 10-minute intervals, the distance which the drill bit 1 has proceeded into the rock 11. The means transmits the result of measurement to the memory unit 12 and to the comparator unit 13. The latter compares the result of measurement with the preceding correction command. On the basis of this comparison, a new correction command goes to the control means 8 of the drill bit feed device 4.

The speed of rotation of the drill bit may be controlled either dependent on the feed force or independent thereof, in many different ways. Ways which have already been mentioned are: the constant rotating power control and the control in which the feed force power and rotation power added together are constant. The speed of rotation, however, can also be held constant.

It is obvious to one skilled in the art that different embodiments of the invention may vary within the scope of the claims set forth hereinbelow.

We claim:

1. A method for controlling the drilling functions of a full profile rock drill apparatus, comprising the steps of controlling the speed of rotation of the cutting head and controlling the feed force of the cutting head so that the rate of penetration of the drill bit reaches its optimum rate as a function of the feed force, said full profile drilling apparatus having a part of the cutting head cutting the rock comprising freely rotable cutters, measuring during the drilling operation the change of the rate of penetration of the cutting head into the rock, and controlling on the basis of said measured change the drilling functions so that the cutting head feed force is either increased or decreased, said feed force of the cutting head being controlled so that if the nearest preceding control action for increasing or decreasing the feed force has increased the rate of penetration of the cutting head then the feed force of the cutting head will be adjusted in the same direction as the nearest preceding adjustment, if the rate of penetration, on the other hand decreased or remained at the same level then the feed force of the cutting head is adjusted in the opposite direction.

2. A method according to claim 1 wherein the drilling functions are controlled on the basis of the change of rate of penetration of the cutting head so that the feed force of the cutting head is adjusted by the apparatus and the speed of rotation of the cutting head is allowed to adjust itself freely, by keeping the rotation power constant.

3. A method according to claim 1 wherein the drilling functions are controlled so that the feed force of the cutting head is adjusted by the apparatus and the speed of rotation of the cutting head is allowed to adjust itself freely by keeping constant the total power expended to produce the rotation and the feeding of the cutting head.

4. A method according to claim 1 characterized in that the drilling functions are controlled so that on the basis on change of penetration rate of the cutting head (1) a correction of predetermined magnitude is given to the cutting head feed force control means (4).

5. A method according to claim 1 wherein the adjustment of the feed force of the cutting head is determined by comparing the change of the rate of penetration with the nearest preceding correction command.

6. A method according to claim 1 wherein the feed force of the cutting head is adjusted so that the specific energy does not exceed a predetermined rate to reach the optimum rate of penetration of the cutting head as a function of the feed force within the limit of the highest permitted specific energy, said specific energy being attained by computing the ratio of the consumed average drilling power per time unit to the distance which the cutting head has penetrated into the rock during the same time unit.

7. A method according to claim 1 wherein the feed force of the cutting head is controlled so that the feed force of the cutting head does not exceed a predetermined rate.

8. A full profile rock drill apparatus comprising a cutting head having a part entering the rock and comprising cutters freely rotatable and carried on an axle a cutting head rotating motor; a cutting head feeding motor and control means for controlling the drilling functions so that the rotation speed and the feed force of the cutting head are controlled to obtain the maximum rate penetration of the cutting head as a function of the feed force, said control means for the drilling functions comprising means measuring the change of the rate of penetration of the cutting head and having means for controlling on the basis of said measured change the drilling functions so that the cutting head feed force is either increased or decreased, said feed force of the cutting head being controlled dependent on the nearest preceding control action for increasing or decreasing the feed force, a memory unit connected to said means for measuring the change of the rate of penetration and storing in memory the preceding control action of the feed force of the cutting head, and a comparator unit connected to said memory means for comparing the change of the rate of penetration of the cutting head to the preceding adjustment command of the feed force of the cutting head, so that the rate of penetration of the drill bit reaches its optimum rate as a function of the feed force.

9. A full profile rock drill apparatus according to claim 8 wherein said means measuring the rate of penetration measures at predetermined time intervals the distances which the cutting head has penetrated into the rock and mutually compares said distances.

10. A full profile rock drill apparatus according to claim 8 wherein said means measuring the rate of penetration of the cutting head continuously measures the rate of penetration of the cutting head.

11. A full profile rock drill apparatus according to claim 8 wherein said control means comprises a memory unit storing at least the preceding adjustment command of the feed force and a comparator unit for comparing the preceding adjustment command at least with the most recent change of the rate of penetration of the cutting head.

12. A full profile rock drill apparatus according to claim 8 wherein the magnitude of the rate of penetration of the cutting head and its direction are stored in the memory unit.

13. A full profile rock drill apparatus according to claim 8 wherein the direction of the preceding adjustment command of the feed force is stored in the memory unit.

14. A full profile rock drill apparatus according to claim 8 wherein said control means of the drilling functions adjusts the feed force of the cutting head; and including auxiliary control means connected to the rotating motor of the cutting head for keeping the power expended for rotation of the cutting head constant.

15. A full profile rock drill apparatus according to claim 8 wherein said control means of the drilling functions adjusts the feed force of the cutting head, and auxiliary control means connected to the rotating motor of the cutting head together with the controlling means of the drilling functions for keeping constant the total power expended to rotate the cutting head and to produce the feed force.

16. A full profile rock drill apparatus according to claim 8 wherein the controlling apparatus of the feed force of the cutting head comprises means limiting the force of the cutting head to a predetermined optimum rate.

17. A full profile rock drill apparatus according to claim 16 wherein said means limiting the feed force of the cutting head is a specific energy computer which computes the ratio of the consumed average drilling power per time unit to the distance which the drill bit has penetrated into the rock during the same time unit, and adjusts the feed force of the cutting head so that the specific energy does not exceed said predetermined rate.

18. A full profile rock drill apparatus according to claim 16 wherein said means limiting the feed force of the cutting head limits the feed force of the drill bit so that it is less than said predetermined optimum rate.

* * * * *